US007286086B2

(12) United States Patent
Fang et al.

(10) Patent No.: US 7,286,086 B2
(45) Date of Patent: Oct. 23, 2007

(54) GAIN-ADJUSTABLE ANTENNA

(75) Inventors: Chien-Hsing Fang, Taipei (TW); Jin-Shu Chang, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 64 days.

(21) Appl. No.: 11/262,453

(22) Filed: Oct. 27, 2005

(65) Prior Publication Data

US 2006/0176218 A1 Aug. 10, 2006

(30) Foreign Application Priority Data

Feb. 5, 2005 (TW) ..... 94103953 A

(51) Int. Cl.
*H01Q 1/38* (2006.01)

(52) U.S. Cl. ..... 343/700 MS; 343/846; 343/853

(58) Field of Classification Search ..... 343/801, 343/810, 816, 795, 700 MS, 846, 853, 754
See application file for complete search history.

(56) References Cited

U.S. PATENT DOCUMENTS 5,568,161 A * 10/1996 Fulmer, Sr. ..... 343/816
6,661,381 B2 * 12/2003 Chen ..... 343/700 MS
6,809,699 B2 * 10/2004 Chen et al. ..... 343/795

* cited by examiner

*Primary Examiner*—Hoang V. Nguyen
(74) *Attorney, Agent, or Firm*—Quintero Law Office

(57) ABSTRACT

A gain-adjustable antenna has at least a first antenna unit with a first radiation element and a second antenna unit with a second radiation element. The first and second antenna units are detachably connected by way of connecting the first and second radiation element to form an array antenna to adjust the gain and the radiation pattern.

14 Claims, 12 Drawing Sheets

110

GAIN-ADJUSTABLE ANTENNA

BACKGROUND

The invention relates to an antenna and more particularly to a gain-adjustable antenna.

The main function of antenna is to transform energy originally carried by a transmission line to the air by means of electromagnetic field and receives and transforms electromagnetic energy from the air to a transmission line.

Antennas are classified as directional or omni-directional depending on the direction of radiation. Some important antenna parameters include frequency range, pattern, VSWR and gain. Antenna gain may affect the transmission range. With the same transmission power and identical receiving amplifier, using high-gain antenna results in longer transmission distance. Antennas with higher gain achieve better communication quality. It is difficult, however, to provide a flexible antenna gain suitable for every environment, because antenna gain is typically a fixed value.

SUMMARY

This invention provides a gain-adjustable antenna device. By combining individual antenna units, the gain and radiation pattern of the antenna device can be adjusted accordingly.

The invention provides a gain-adjustable antenna having at least a first antenna unit with a first radiation element and a second antenna unit with a second radiation element. The first and second antenna units are detachably connected by connecting first and second radiation elements can be assembled. An antenna array, for adjusting gain and radiation pattern can be assembled. In one embodiment the first antenna unit comprises a female connector and the second antenna comprises a male connector. The first antenna unit is electrically connected to the second antenna unit by inserting the male connector to female connector.

In another embodiment, the first antenna unit further comprises a first radiation element disposed on the first side of the first substrate and a first conductive layer disposed on the second side of the first substrate. The female connector is provided with a first connection part coupling to the first radiation element. The first radiation element is used for grounding and radiation. The first substrate comprising an impedance-matching circuit and a transmission line is used for transmitting signals. The impedance-matching circuit transforms the resistance of the antenna unit combination to nearly 50 ohms and the transmission line is connected to impedance-matching circuit and external circuit.

In some embodiments, the second antenna unit further comprises a second substrate and the second radiation element is disposed on the first side thereof. A second conductive layer is disposed on the second side of the second substrate. The male connector comprises a second connection part for coupling to the second radiation element. The second radiation element is used for grounding and radiation. The second substrate is used for transmitting signals.

DETAILED DESCRIPTION OF THE INVENTION

The gain-adjustable antenna described by this invention comprises one or more antenna units which are detachably connected. The gain of the combined antenna units depends on the numbers of antenna units Installed.

Figure 1:
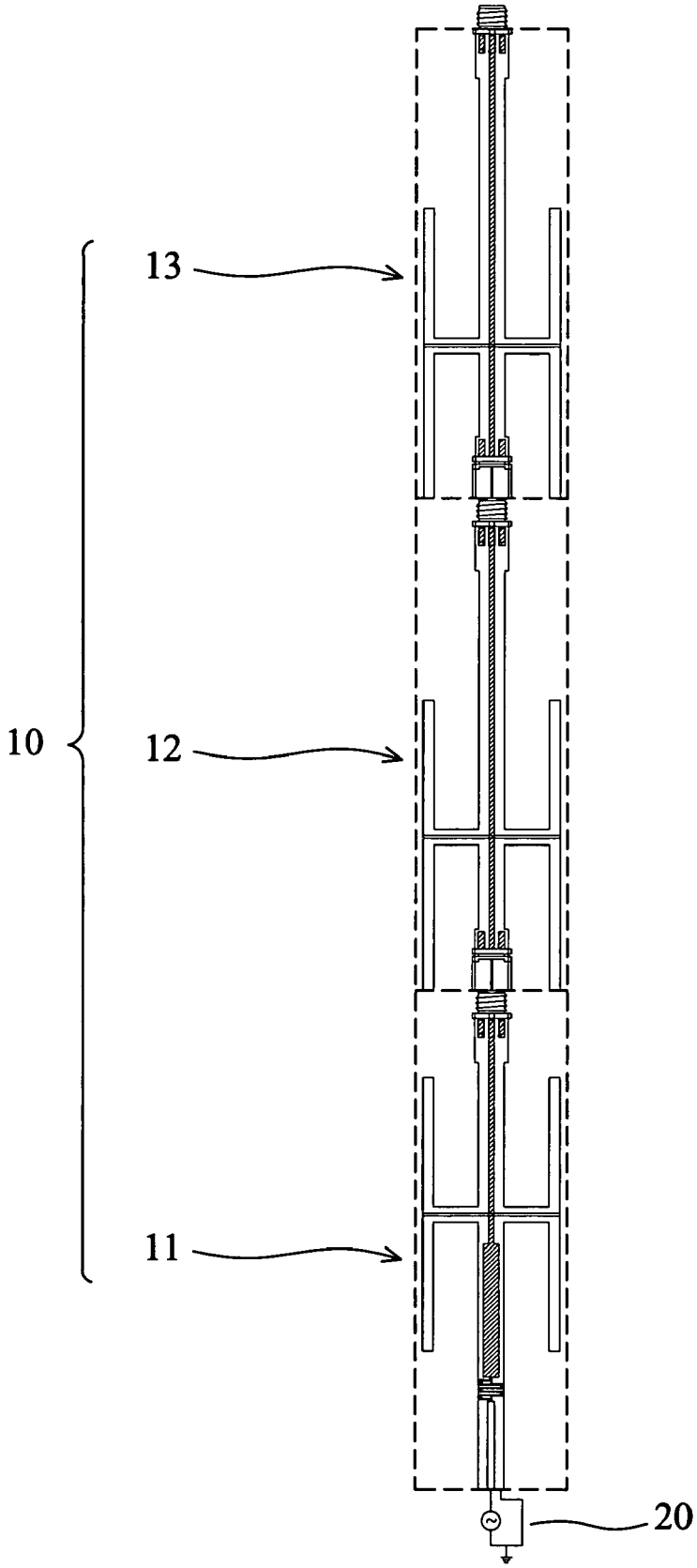
FIG. 1 is a schematic diagram for an embodiment of a gain-adjustable antenna of the invention.

In FIG. 1, the gain-adjustable antenna 10 comprises multiple antenna units 11, 12 and 13 coupling to an external circuit (eg. a signal source).

Figure 2:
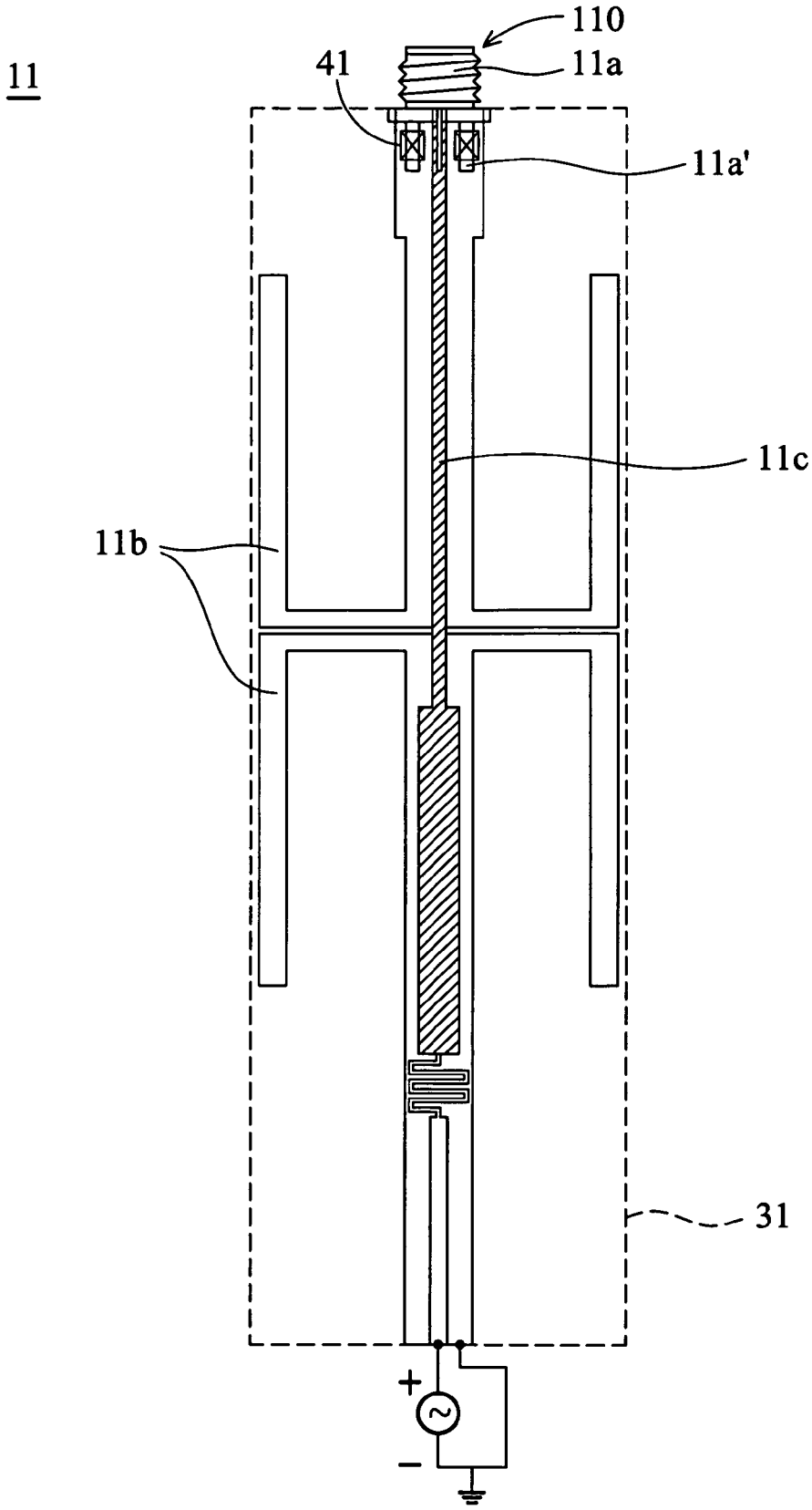
FIG. 2 is a schematic diagram of a first antenna unit of FIG. 1.
Figure 3:
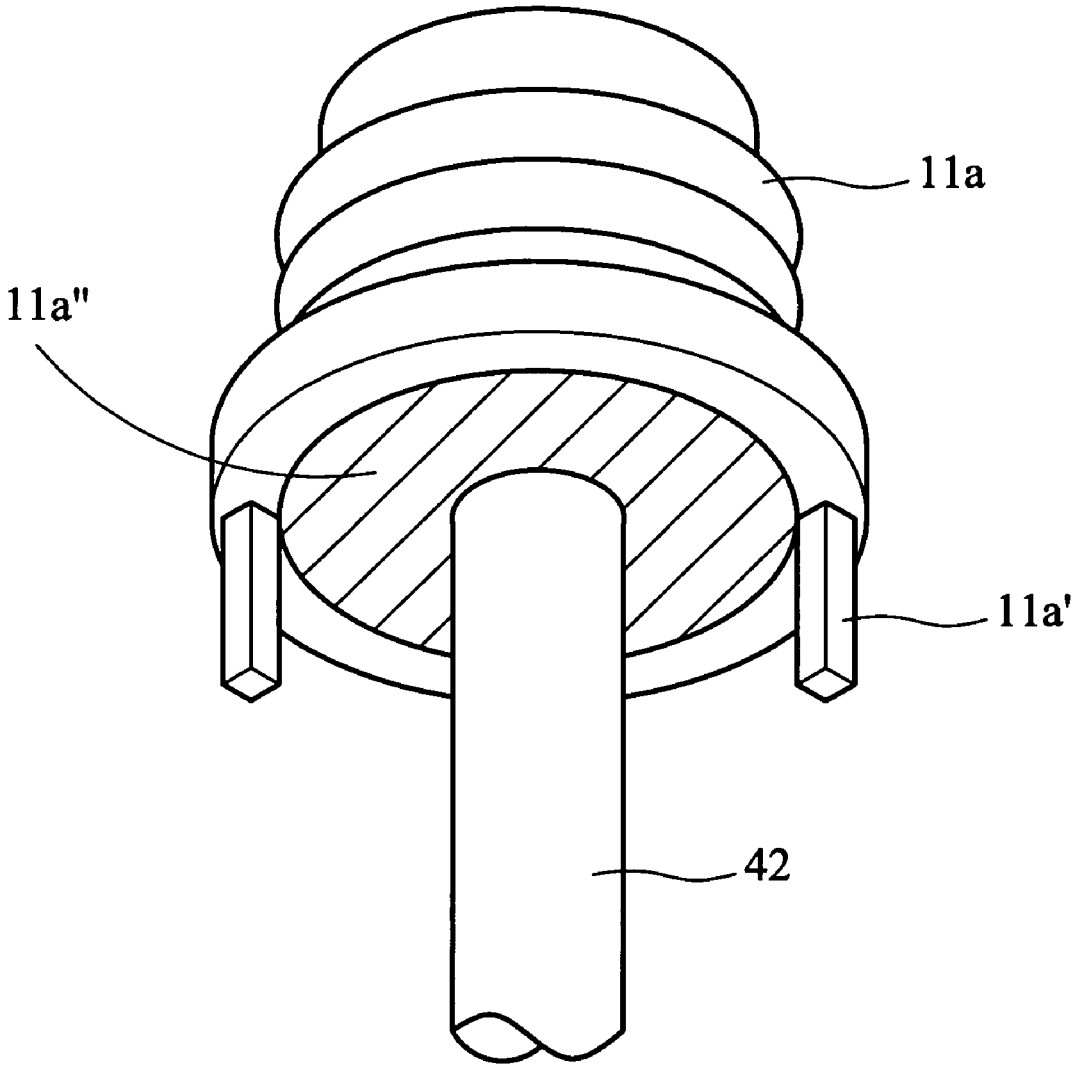
FIG. 3 is an enlarged diagram of part of the FIG. 2.

As show in FIG. 2 and FIG. 3, the first antenna unit 11 comprises a first substrate 31, such as a printed circuit board. A first radiation element 11*b* is disposed on the first side of the first substrate 31 for grounding and radiation. A first conductive layer 11*c* is disposed on the second side of the first substrate for transmitting signals. Assume that the wave length of electric wave transmitted by the antenna is λ and each length of radiation element can be $$\frac{\lambda}{4} \text{ or } \frac{\lambda}{2}.$$

The first radiation element 11*b* and the first conductive layer 11*c* can be copper or microstrip.

Figure 4:
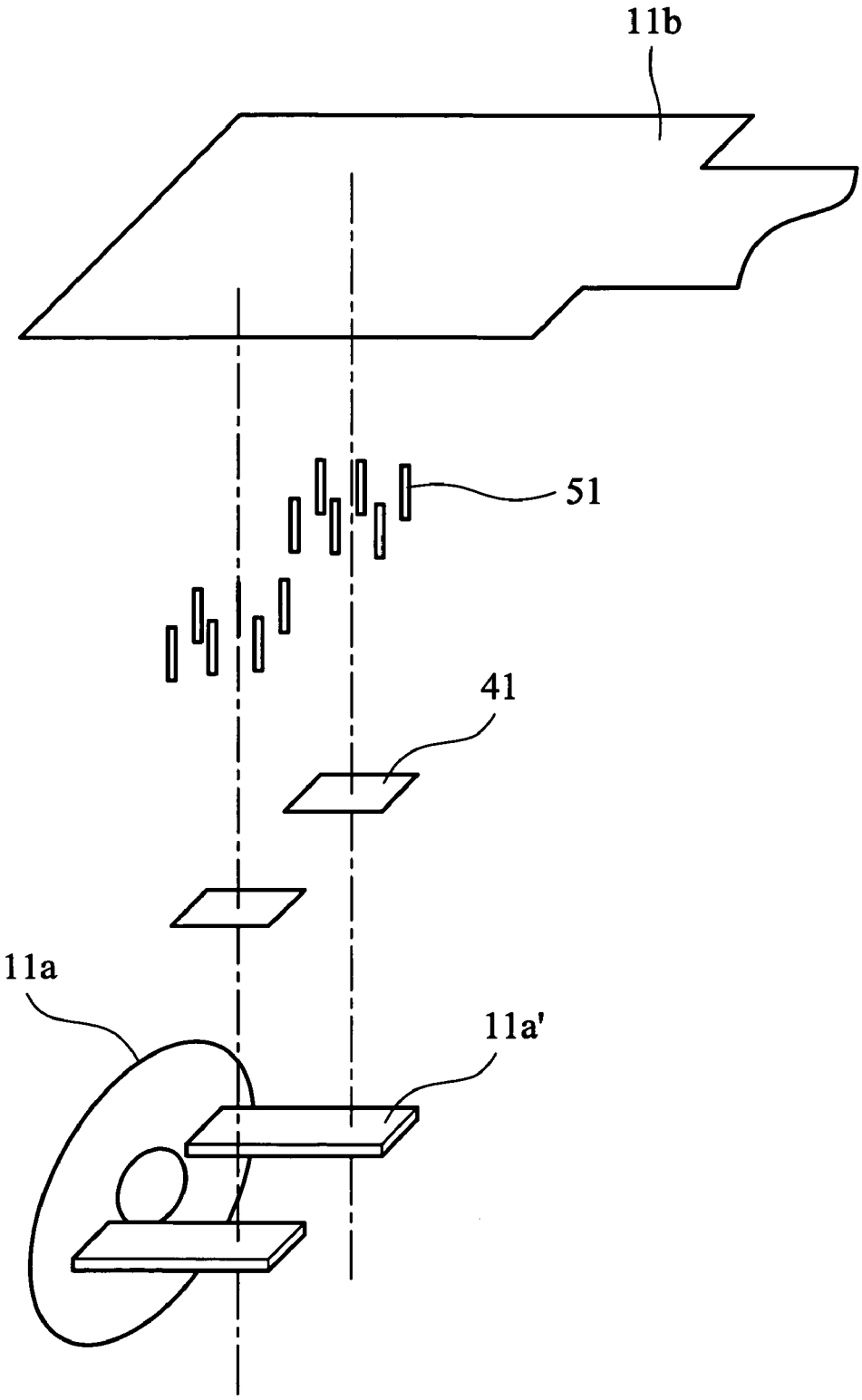
FIG. 4 is a schematic diagram of the connection between the radiation element and the conductive layer.

The first antenna unit 11 further comprises a connector, such as a female connector 110. Female connector 110 comprises a first connecting part 11*a*' on the conductive layer (copper tinsel) disposed on the first substrate 31 allowing the housing 11*a* of female connector 110 to couple with first radiation element 11*b*. A signal device 42 of female connector 110 showed in FIG. 3 is connected via the nonconductor 11*a*" thereof female connector to isolate housing 11*a* and couple to the first conductive layer 11*c*. The conductive layer 41 shown in FIG. 2 and FIG. 4 can be disposed on the second side of the first substrate 31 via through-hole 51 of the first substrate 31 and electrically connected to the first radiation element 11*b* disposed on the first side of the first substrate 31.

Figure 5:
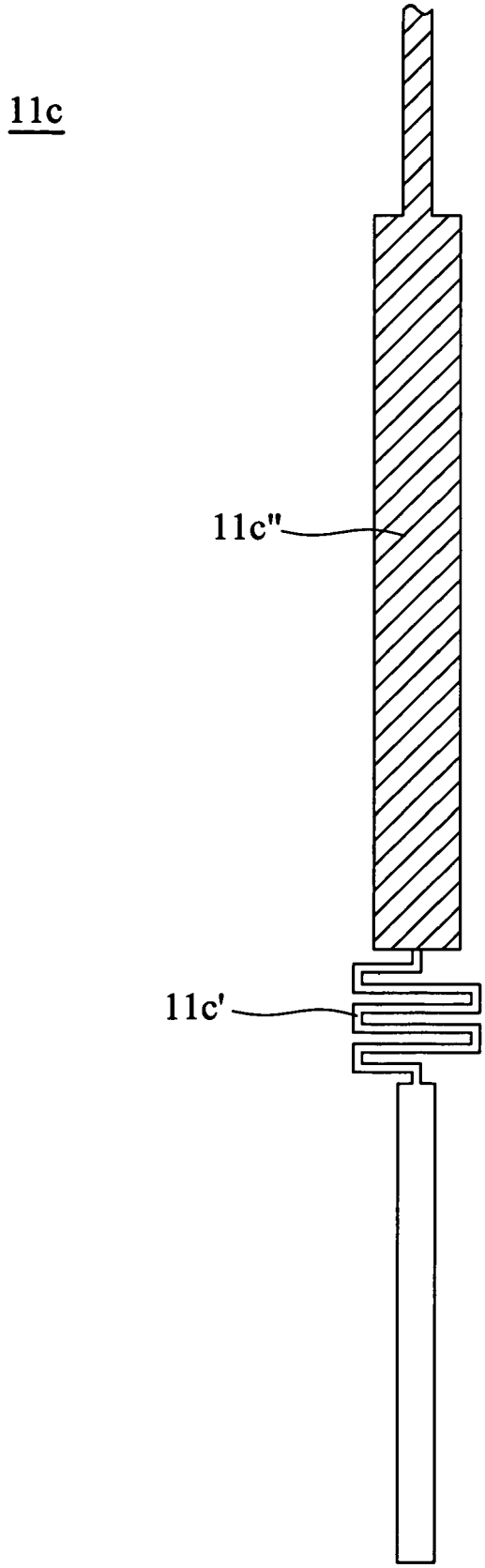
FIG. 5 is a schematic diagram of the first conductive layer of FIG. 2.

As shown in FIG. 5, the first conductive layer 11*c* comprises an impedance-matching circuit 11*c*'and a transmission line 11*c*". The impedance-matching circuit allows the resistance of the antenna to meet the specifications, the antenna such as the resistance of the antenna is nearly 50 ohms and the VSWR is under 2.0) and transmission line 11*c*" and couple to the impedance-matching circuit 11*c*' and an external circuit 20.

Figure 6:
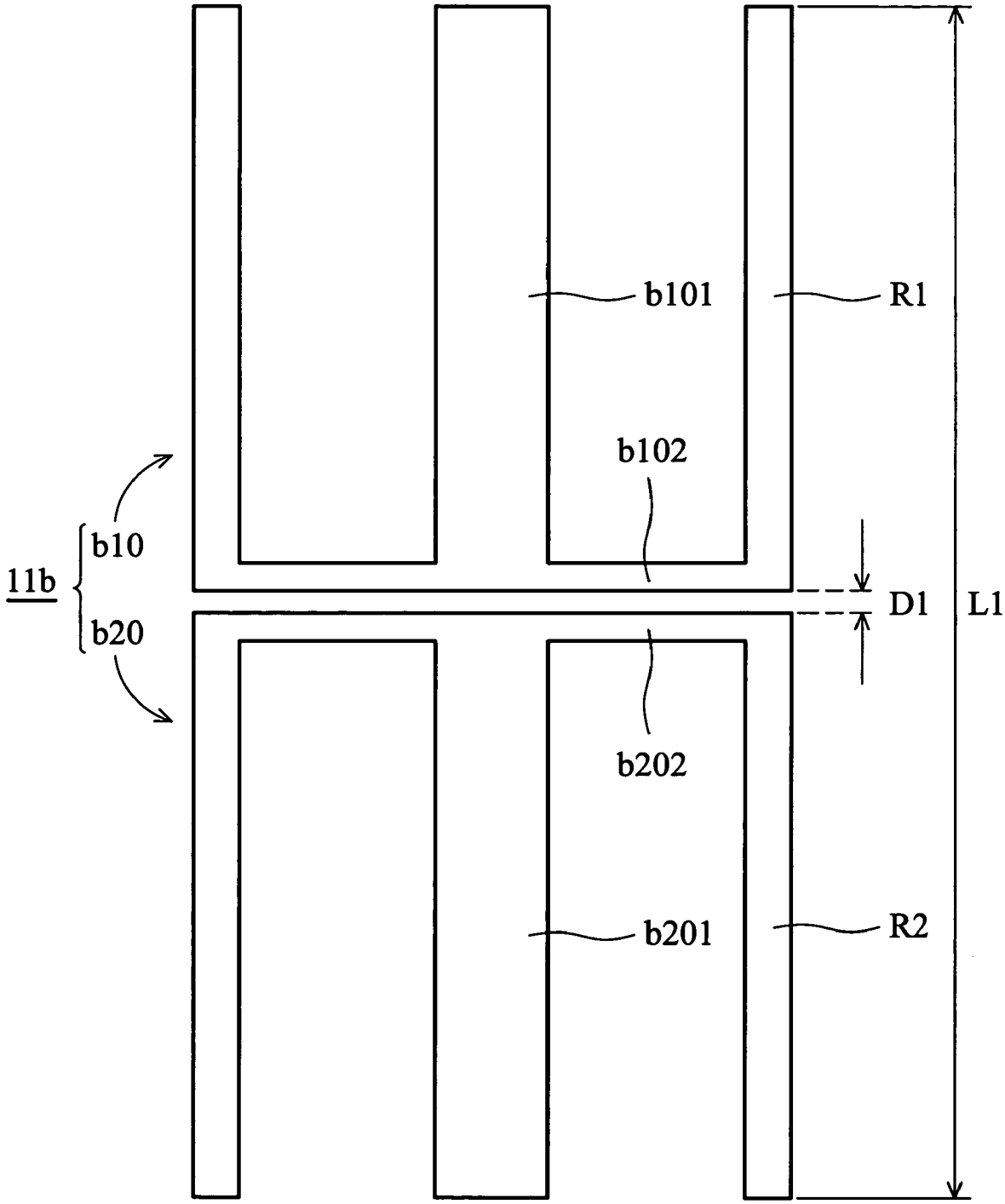
FIG. 6 is a schematic diagram of the first radiation element of FIG. 2.

FIG. 6 is a structural drawing of the first radiation element 11*b* of the first antenna unit 11. The length of the radiation element can be $$\frac{\lambda}{4} \text{ or } \frac{\lambda}{2},$$

including the first section b10 and the second section b20, where the first section b10 is a predetermined distance D1 from the second section b20. The first section b10 comprises the first grounding area b101 and the second grounding area b102 extended from the first grounding area b101. And two first radiation area R1 stretch from the second grounding area b102. The second section b20 comprises the third grounding area b201 and the fourth grounding area b202 extended from the third grounding area b201. Two second radiation areas R2 stretch from the fourth grounding area b202. In this embodiment the first grounding area b101 is substantially parallel to the first radiation area R1. The third grounding area b201 is substantially parallel to the second radiation area R2. The second grounding area b102 is substantially parallel to the fourth grounding area b202 and substantially perpendicular to the first grounding area b101.

Figure 7:
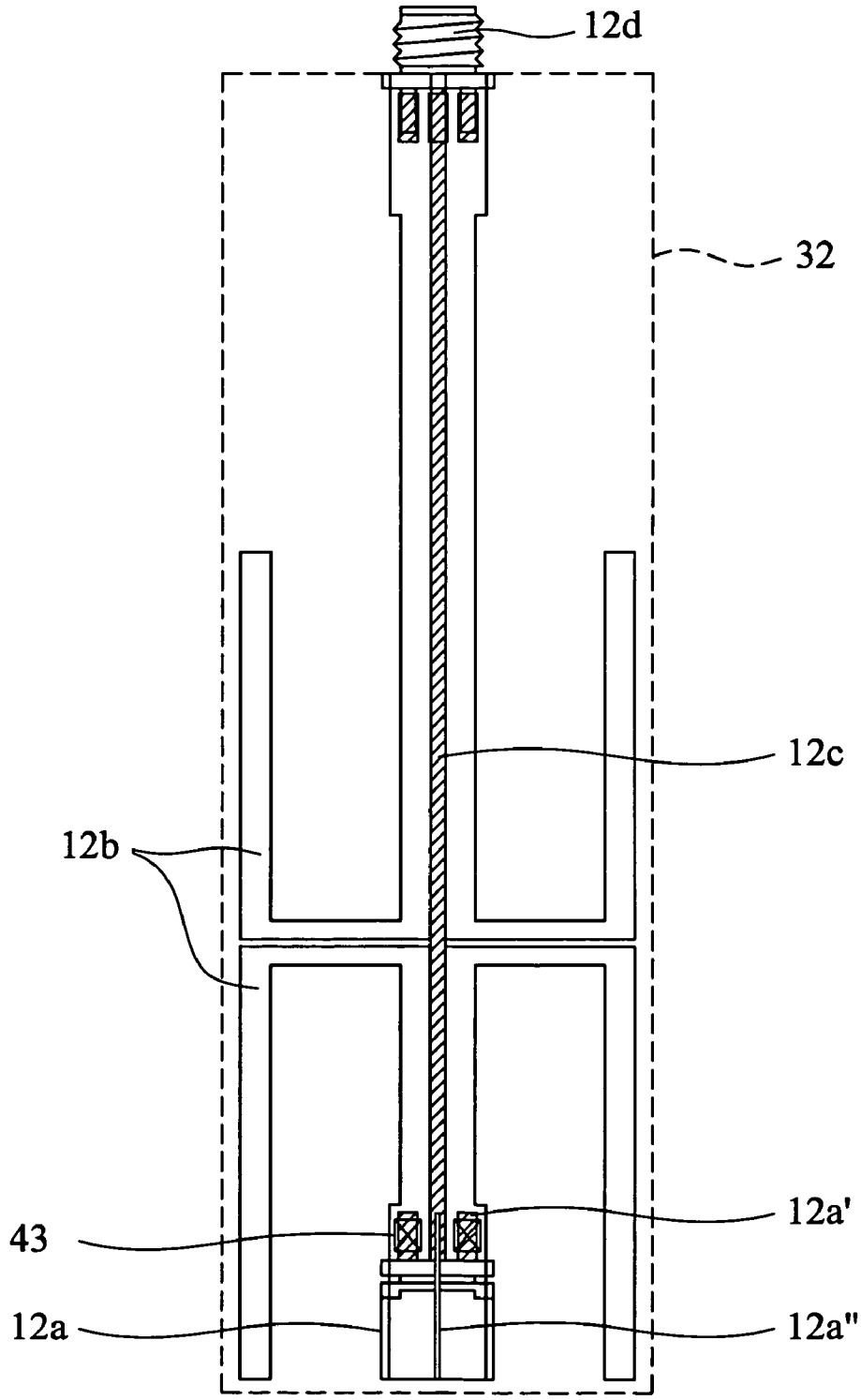
FIG. 7 is a schematic diagram of the second antenna unit of FIG. 2.

As show in FIG. 7, the second antenna unit 12 comprises a second substrate 32, such as a printed circuit board. A second radiation element 12*b* is disposed on the first side of the second substrate 32 for grounding and radiation. A second conductive layer 12*c* is disposed on the second side of the second substrate for transmitting signals. The second radiation element 12*b* and the second conductive layer 12*c* can comprise copper or microstrip.

The second antenna unit 12 further comprises a male connector 12*a* and a female connector 12*d*. Male connector 12*a* further comprises a second connection part 12*a*' to allow the housing of male connector 12*a* to couple to the mentioned second radiation element 12*b* via conductive layer 43 (copper tinsel) disposed on the second substrate 32. A signal device 12*a*" of female connector 12*d* is coupled to the second conductive layer 11*c*. Refer to the design of the conductive layer 41 in FIG. 4, the conductive layer 43 was the same design that of the conductive layer 43 and can be disposed on the second side of the first substrate 31 via through-hole 51 of the first substrate 31 electrically connected to the first radiation element 11*b* disposed on the first side of the first substrate 31. The male connector 12*a* is coupled to female connector 12*d* to allow the first antenna unit 11 to connect to the second antenna unit 12. The usage of female connector 12*d* of the second antenna unit 12 is the same as male connector 12*a* for connecting to extra antenna units.

Figure 8:
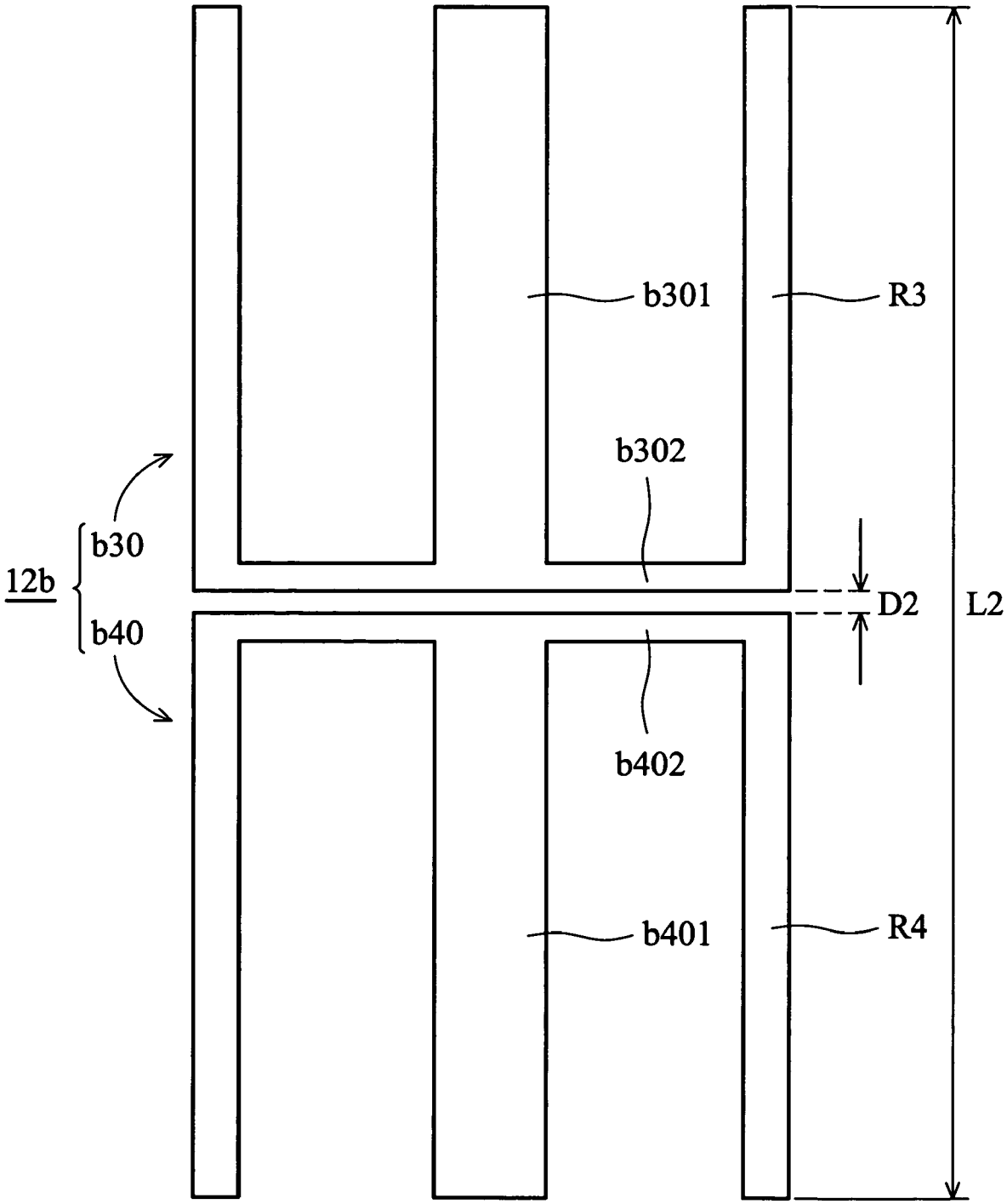
FIG. 8 is a schematic diagram of the second radiation element of FIG. 7.

As show in FIG. 7 and FIG. 8, the length L2 of second radiation element 12*b* of the second antenna unit 12 can be $$\frac{\lambda}{4} \text{ or } \frac{\lambda}{2}$$

including the third section b30 and the four section b40 where the third section b30 is separated by a distance D2 from the fourth section b40. The third section b30 comprises a fifth grounding area b301 and a sixth grounding area b302 extended from the fifth grounding area b301. The two third radiation areas R3 are extended from the sixth grounding area b302. The fourth section b40 comprises a seventh grounding area b401 and a eighth grounding area b402 extended from the seventh grounding area b401. The two fourth radiation areas R4 are extended from the eighth grounding area b402. In this embodiment, the fifth grounding area b301 is substantially parallel to the third radiation area R3. The seventh grounding area b401 is substantially parallel to the fourth radiation area R4. The sixth grounding area b302 is substantially parallel to the eighth grounding area b402 and substantially perpendicular to the fifth grounding area b301. The signal transmitting structure of the second conductive layer 12*c* of the second antenna unit 12 is the same as the transmission line 11*c*" (refer to FIG. 4) of the first conductive layer 12*c*.

Figure 12:
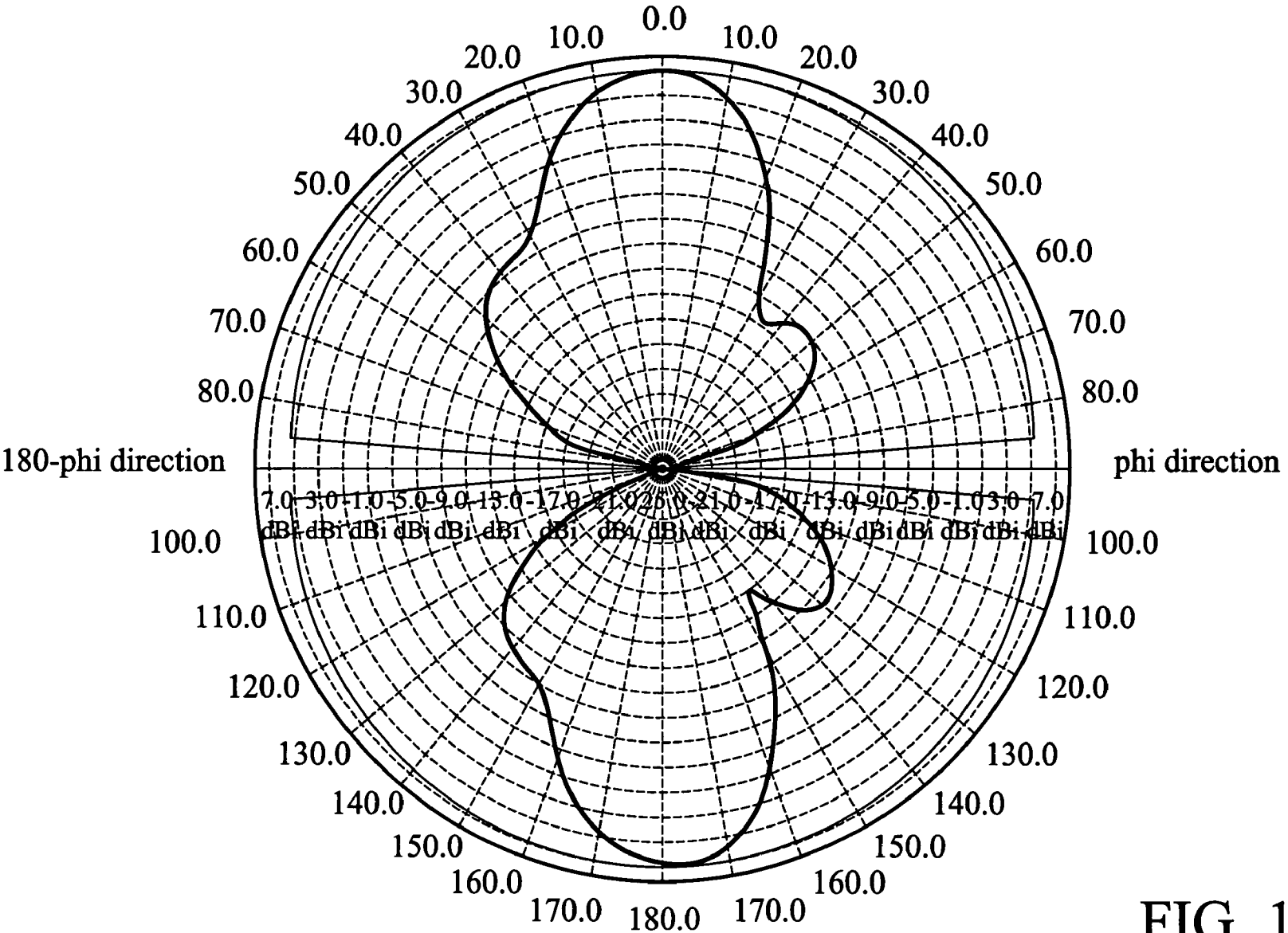

Note that the distance D1 of the first radiation element 12*b* and D2 of the second radiation element 11*b* are both in a range from 0.001 λ~0.1 λ (λ is the transmitting wave length of the antenna). Take the first radiation element 11*b* for example, when electric charges circulated in the first conductive layer 11*c* pass through the second and fourth grounding area, the first radiation area R1 and the second radiation area R2 will transmit waves caused by discontinuous grounding between the second and the fourth grounding area because of the distance D1 between second and fourth grounding area. The remaining energy will pass through transmission line until coming across the next discontinuous grounding gap to radiate. This invention connects multiple antenna units flexibly to form a phase array antenna by increasing or decreasing antenna units to adjust the gain and radiation field of the combination antenna. Further illustrations, when multiple antenna units are connected flexibly, the resistance of the combination antenna tends toward a fixed value of the impedance-matching circuit. This means that the resistance of combination antenna can meet the demands of the antenna.

ig. 9 to FIG. 12 respectively shows vertical plane radiation field of the gain-adjustable antenna in different combinative configurations. In this embodiment the distances D1 and D2 are both 0.004λ.

Figure 9:
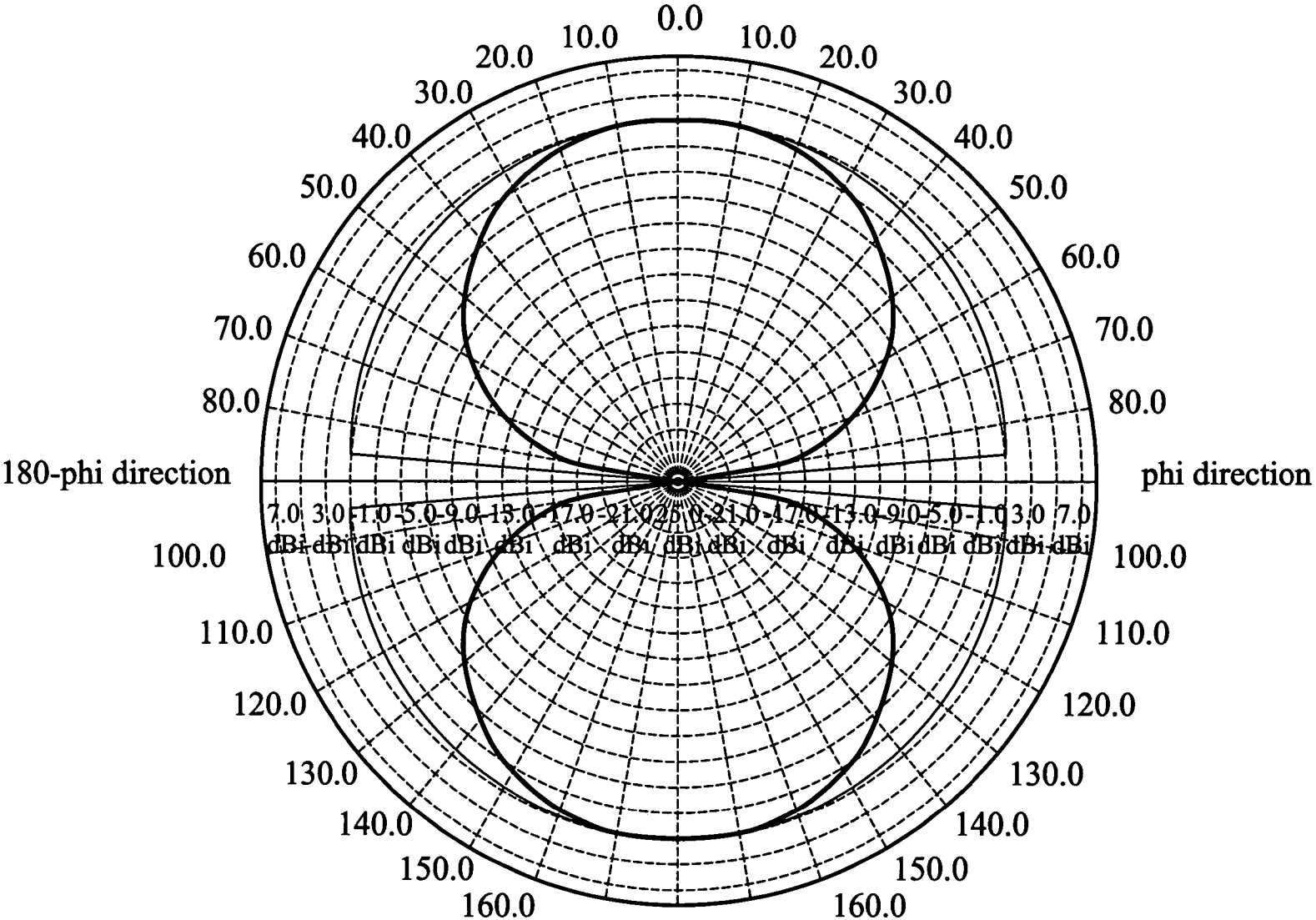
FIG. 9 to FIG. 12 respectively shows the radiation field on vertical plane of the gain-adjustable antenna device under different combination.
Figure 10:
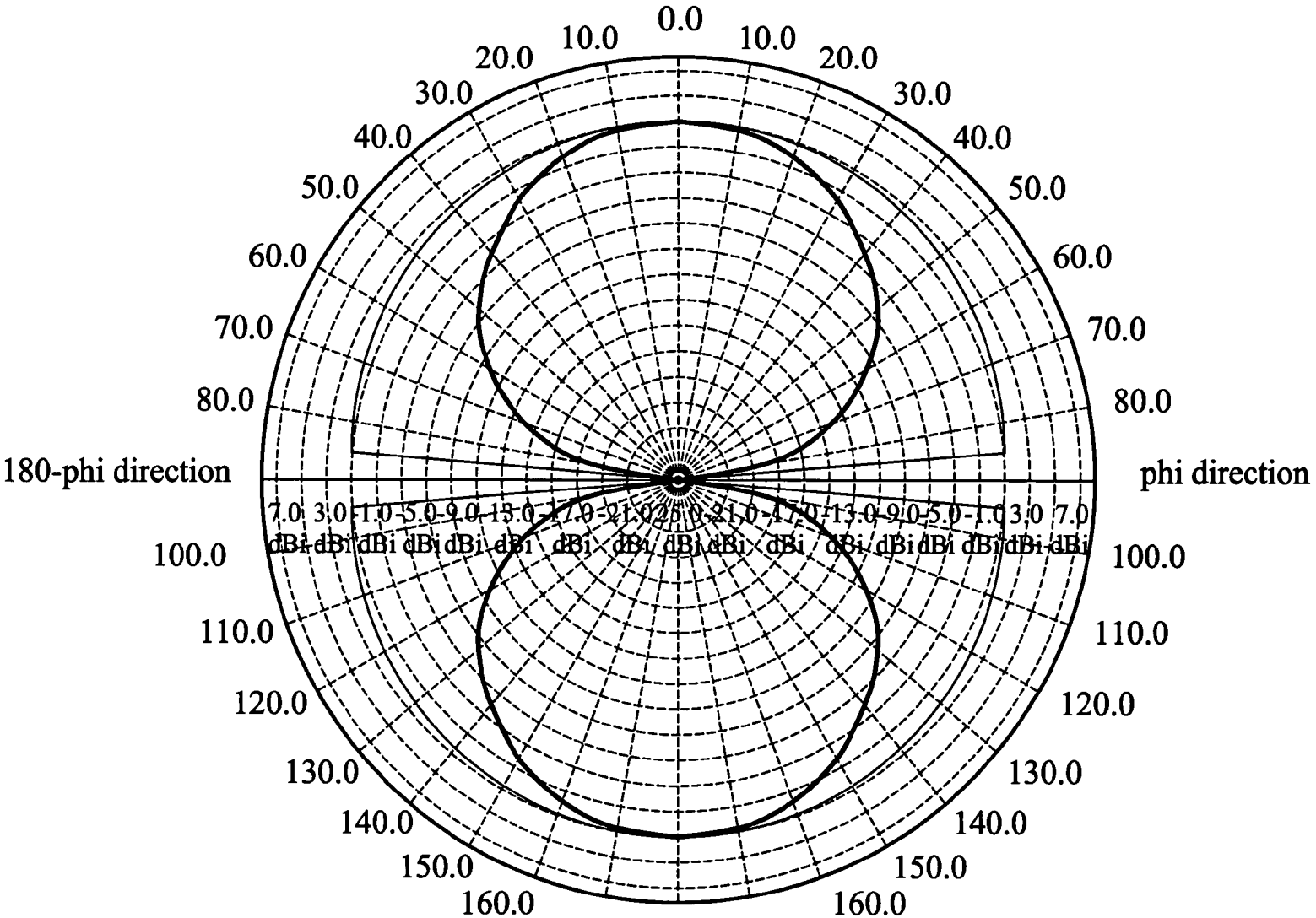

In FIG. 9, the gain-adjustable antenna only uses one antenna unit and when the transmitting frequency is 2400 MHz, a directivity gain is about 3.47 dBi. In FIG. 10, the gain-adjustable antenna uses a second antenna unit 12 with an extra impedance-matching circuit (not show in figure). The extra impedance-matching circuit provides substantially 50 ohms of resistance. When the transmitting frequency is about 2400 MHz, the directivity gain is about 3.52 dBi. The first antenna unit is similar to the second antenna unit so that the gain of the two antennas is similar. The designer can change the geometric structure or resistance of the conductive layer of the first and second antenna units to reach the desired directivity gain.

Figure 11:
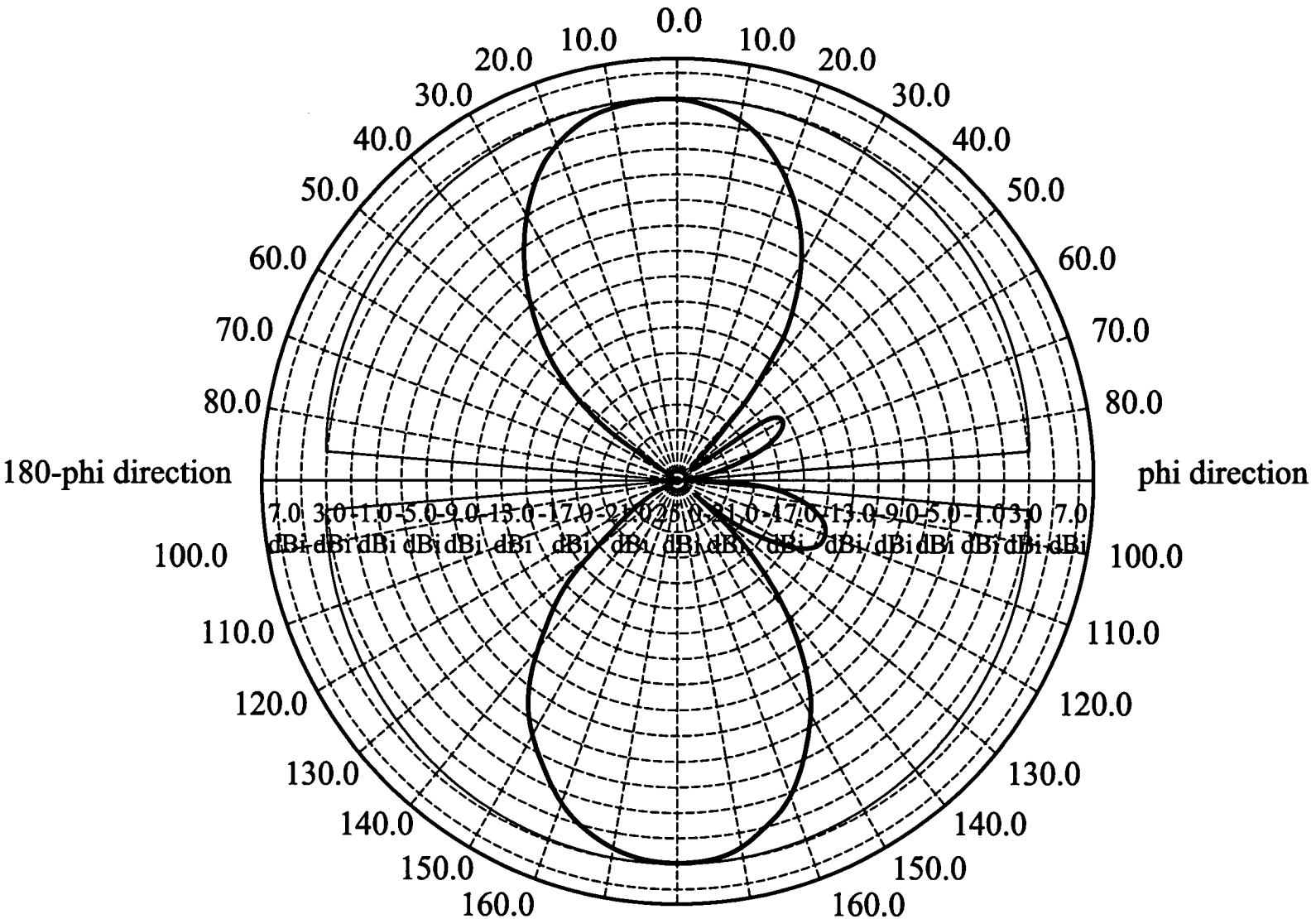

In FIG. 11, the gain-adjustable antenna comprises two antenna units, such as the first or second antenna unit. When the transmitting frequency is 2400 MHz, the directivity gain of the gain-adjustable antenna of FIG. 11 is about 5.88 dBi. In FIG. 12, the gain-adjustable antenna comprises three antenna units, such as a first antenna unit 11 and two second antenna units 12. When the transmitting frequency is 2400 MHz, the directivity gain is 7.06 dBi.

As mentioned above, the present disclosure discloses a method of flexibly connecting individual antenna units to control the directivity gain of the antenna according the amount of antenna units to meet various requirements.

A suitable antenna gain can be obtained in different environments to achieve the best possible communication quality by increasing or decreasing the numbers of antenna units adjusting the antenna gain.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An adjustable antenna device, comprising:

a first antenna unit with a first radiation element, wherein the first antenna unit further comprises:

a first substrate, wherein the first radiation element is disposed on a first side of the first substrate to provide the grounding and radiating functions of the gain-adjustable antenna, and the first radiation element comprises a first part and a second part and a gap is formed between the first and second parts; and a first conductive layer disposed on a second side of the first substrate to transmit signals; and a second antenna unit with a second radiation element, wherein the first antenna unit is with the second antenna unit, wherein the gain of the adjustable antenna can be adjusted by connecting the first radiation element and the second radiation element to form an array antenna to adjust the gain and the radiation pattern.

2. The adjustable antenna of claim 1, wherein the first part comprises a first ground region, a second ground region extended from the first ground region, and a first radiation region extended from the second ground region, wherein the second part comprises a third ground region, a fourth ground region extended from the third ground region, and a second radiation region extended from the fourth ground region.

3. The adjustable antenna of claim 2, wherein the first ground region is substantially parallel to the first radiation region, the third ground region is substantially parallel to the second radiation region, the second ground region is substantially parallel to the fourth ground region and is substantially perpendicular to the first ground region.

4. The adjustable antenna of claim 3, wherein the width of the gap between the first and second parts is between $0.001\lambda$ and $0.1\lambda$, in which $\lambda$ is a wavelength transmitted by the gain-adjustable antenna.

5. The adjustable antenna of claim 2, wherein the first antenna unit further comprises a first connector with a first connection part and a signal part, wherein the first connection part couples to the first ground region and the signal part couples to the first conductive layer.

6. The adjustable antenna of claim 5, wherein the first antenna unit further comprises a conductive connection layer disposed on the second side of the first substrate, wherein the first substrate comprises a through-hole for interconnecting the first connection part of the first connector to connect to the first ground region.

7. The adjustable antenna of claim 2, wherein the first radiation region is substantially in line with the second radiation region and the sum of the lengths of the first and second radiation regions is substantially $$\frac{1}{2}\lambda \text{ or } \frac{1}{4}\lambda,$$

in which $\lambda$ is a wavelength transmitted or received by the adjustable antenna.

8. The adjustable antenna of claim 1, wherein the second antenna unit further comprises:

a second substrate, wherein the second radiation element is disposed on a first side of the second substrate to provide the grounding and radiating functions of the adjustable antenna, and wherein the second radiation element further comprises a third part and a fourth part in which a gap is formed between third part and the fourth part; and a second conductive layer disposed on a second side of the second substrate to transmit signals.

9. The adjustable antenna of claim 8, wherein the third part comprises a fifth ground region, a sixth ground region extended from the fifth ground region, and a third radiation region extended from the sixth ground region, wherein the fourth part comprises a seventh ground region, an eighth ground region extended from the seventh ground region, and a fourth radiation region extended from the eighth ground region.

10. The adjustable antenna of claim 9, wherein the fifth ground region is substantially parallel to the third radiation region, the seventh ground region is parallel to the fourth radiation region, the sixth ground region is substantially parallel to the eighth ground region and is substantially perpendicular to the fifth ground region.

11. The adjustable antenna of claim 9, wherein the second antenna unit further comprises a second connector with a second connection part and a signal part, wherein the second connection part couples to the fifth ground region and the signal part couples to the second conductive layer.

12. The adjustable antenna of claim 11, wherein the second antenna unit further comprises a conductive connection layer disposed on the second side of the second substrate, wherein the second substrate comprises a through-hole for interconnecting the second connection part of the second connector to the fifth ground region.

13. The adjustable antenna of claim 8, wherein the width of the gap between the third and fourth parts is between $0.001\lambda$ and $0.1\lambda$, in which $\lambda$ is a wavelength transmitting by the gain-adjustable antenna.

14. An adjustable antenna device, comprising:

a first antenna unit with a first radiation element; and a second antenna unit with a second radiation element, wherein the second antenna unit further comprises:

a substrate, wherein the second radiation element is disposed on a first side of the substrate to provide the grounding and radiating functions of the adjustable antenna; and a conductive layer disposed on a second side of the substrate to transmit signals, wherein the conductive layer comprises a transmission circuit for connecting to the first antenna unit and for transmitting signals;

wherein the first antenna unit is with the second antenna unit, wherein the gain of the adjustable antenna can be adjusted by connecting the first radiation element and the second radiation element to form an array antenna to adjust the gain and the radiation pattern.

* * * * *